US005868200A

United States Patent [19]

Bryant et al.

[11] Patent Number: 5,868,200

[45] Date of Patent: Feb. 9, 1999

[54] ALTERNATE-PATH WELL SCREEN HAVING PROTECTED SHUNT CONNECTION

[75] Inventors: David Wade Bryant, Abita Springs, La.; George A. Gillespie, Coon Rapids; Steven J. Tupy, Webster, both of Minn.

[73] Assignee: Mobil Oil Corporation, Fairfax, Va.

[21] Appl. No.: 837,401

[22] Filed: Apr. 17, 1997

[51] Int. Cl.[6] ..... E21B 43/04

[52] U.S. Cl. ..... 166/51; 166/242.3

[58] Field of Search ..... 166/241.6, 230, 166/51, 278, 242.3; 285/45

[56] References Cited

U.S. PATENT DOCUMENTS

| | | | |
|---|---|---|---|
| 4,945,991 | 8/1990 | Jones | 166/278 |
| 5,082,052 | 1/1992 | Jones et al. | 166/51 |
| 5,113,935 | 5/1992 | Jones et al. | 166/51 |
| 5,161,613 | 11/1992 | Jones | 166/242.3 |
| 5,341,880 | 8/1994 | Thorstensen et al. | 166/278 |
| 5,390,966 | 2/1995 | Cox et al. | 285/137.1 |
| 5,417,284 | 5/1995 | Jones | 166/280 |
| 5,419,394 | 5/1995 | Jones | 166/51 |
| 5,476,143 | 12/1995 | Sparlin et al. | 166/233 |
| 5,515,915 | 5/1996 | Jones et al. | 166/51 |
| 5,588,487 | 12/1996 | Bryant | 166/51 |
| 5,624,560 | 4/1997 | Voll et al. | 166/230 |

*Primary Examiner*—Tamara L. Graysay
*Assistant Examiner*—Abdel G. Elkassed
*Attorney, Agent, or Firm*—Malcolm D. Keen

[57] ABSTRACT

An alternate-path, well screen made-up of joints and having a sleeve positioned between the ends of adjacent joints which acts as a manifold for fluidly-connecting the alternate-paths on one joint with the alternate-paths on an adjacent joint.

7 Claims, 3 Drawing Sheets

ALTERNATE-PATH WELL SCREEN HAVING PROTECTED SHUNT CONNECTION

DESCRIPTION

1. Technical Field

The present invention relates to an alternate-path, well screen and in one of its aspects relates to an alternate-path, well screen of the type used in gravel-pack completions of well bores wherein the fluid connections between the alternate paths (e.g. shunt tubes) on adjacent joints of screen are protected from damage during installation and operation.

2. Background

In producing hydrocarbons or the like from loosely or unconsolidated and/or fractured formations, it is not uncommon to produce large volumes of particulate material along with the formation fluids. As is well known in the art, these particulates routinely cause a variety of problems and must be controlled in order for production to be economical. Probably the most popular technique used for controlling the production of particulates (e.g. sand) from a well is one which is commonly known as "gravel packing".

In a typical gravel rack completion, a screen is lowered into the well bore on a workstring and is positioned adjacent the subterranean formation to he completed: e.g. a production formation. Particulate material, collectively referred to as "gravel", and a carrier fluid is then pumped as a slurry down the workstring where it exits through a "cross-over" into the well annulus formed between the screen and well casing or open hole, as the case may be.

The carrier liquid in the slurry normally flows into the formation and/or through the screen, itself, which, in turn, is sized to prevent flow of gravel therethrough. This results in the gravel being deposited or "screened out" in the well annulus where it collects to form a gravel pack around the screen. The gravel, in turn, is sized so that it forms a permeable mass which allows flow of the produced fluids therethrough and into the screen while blocking the flow of the particulates produced with the production fluids.

One of the major problems associated with gravel packing, especially where long or inclined or horizontal intervals are to be completed, arises from the difficulty in distributing the gravel over the entire completion interval; i.e. completely packing the entire length of the well annulus around the screen. This poor distribution of gravel (i.e. incomplete packing of the interval) is often caused by the carrier liquid in the gravel slurry being lost into the more permeable portions of the formation interval which, in turn, causes the gravel to form "sand bridges" in the annulus before all of the gravel has been placed. Such bridges block further flow of slurry through the annulus thereby preventing the placement of sufficient gravel (a) below the bridge in top-to-bottom packing operations or (b) above the bridge in bottom-to-top packing operations.

To alleviate this problem, "alternate-path" well screens have recently been developed which provide good distribution of gravel throughout the entire completion interval even if sand bridges form before all of the gravel has been placed. For example of such screens, see U.S. Pat. Nos. 4,945,991; 5,082,052; 5,113,935; 5,417,284; and 5,419,394. In these well screens, the alternate-paths (e.g. perforated shunts or by-pass conduits) extend along the length of the screen and are in fluid communication with the gravel slurry as the slurry enters the well annulus around the screen. If a sand bridge forms in the annulus, the slurry is still free to flow through the conduits and out into the annulus through the perforations in the shunt tubes to complete the filling of the annulus above and/or below the sand bridge.

There are at least two major factors to be considered in assembling and using alternate-path well screens. One is the protection of the shunt tubes during installation and the other is making the necessary fluid connections between the shunts tubes on adjacent lengths or joints of screen when the well screen is made-up and lowered into the wellbore.

First, due to the relative small size of the alternate-paths (i.e. shunt tubes), it is vitally important that they are not crimped or otherwise damaged during the installation of the screen. One proposal for protecting these shunts is to place them inside the outer surface of the screen; see U.S. Pat. Nos. 5,476, 143 and 5,515,915. However, this normally increases the cost of this type screen thereby making it substantially more expensive than other types of commercially-available screens presently used for the same purpose. Accordingly, it appears more desirable, at least from an economic standpoint, to merely position and secure the by-pass conduits or shunt tubes onto the external surface of an appropriate, commercially-available well screen in order to be competitive. Unfortunately, however, this exposes the externally-positioned shunt tubes to damage during installation of the screen.

Another technique proposed for protecting externally-positioned shunt tubes involves concentrically mounting a perforated, protective shroud over the screen and the associated shunt tubes. This shroud protects the shunt tubes from any damaging impacts or the like during installation and/or operations of the screen; see commonly-assigned, co-pending application Ser. No. 08/719,923 filed Sep. 25, 1996. While such a shroud provides good protection for the shunt tubes lying along the screen, it offers no protection for the connections between shunt tubes on adjacent joints which are necessary for respective shunt tubes to provide a continuous flowpath along the length of the well screen.

Further, at present, it is both difficult and time consuming to make all of the fluid connections between the respective shunt tubes which are required in making-up a typical alternate-path well screen. For example, the length of a typical alternate path well screen is normally substantial (e.g. 1000 feet or more) and is made up of a plurality of 20 foot or longer joints. Each joint is basically similar to the others in that they all are comprised of a permeable section (i.e length of screen material) having a plurality of axially-extending, individual shunt tubes positioned thereon to form an integral "joint" of screen.

In making-up or assembling most of these prior art alternate-path well screens, the desired number of joints are secured together by first coupling the "base pipes" of the screen joints together and then individually, fluidly connecting each of the shunt tubes on a joint to its respective shunt tube on the adjacent joint. Since a typical joint normally has a plurality of parallel, axially-extending shunt tubes thereon (i.e. at least four for long screens), four individual connections are required in making up the necessary fluid connections between the shunt tubes of any two adjacent joints thereby requiring eight different physical manipulations for each joint (i.e one at each end of each individual connector). Therefore, for a 1000 foot well screen comprised of fifty, 20-foot joints, 200 connectors (i.e. 400 actual connections) are required to assemble the well screen. As can be appreciated, this tedious assembly procedure adds substantially to the time and overall costs involved in using prior alternate path well screens.

One proposed technique for reducing both the number of connectors and the time required in assembling an alternate-path screen is disclosed in U.S. Pat. No. 5,390,966, issued Feb. 21, 1995 wherein a single connector is used to make a fluid connection between four sets of respective shunt tubes. The connector is slidably positioned on the base pipe at one end of a screen joint so that respective ends of the shunt tubes are received within passages in the connector after the base pipes on adjacent joints are threaded together. While this eliminates handling several individual connectors at each joint, it still requires that each shunt tube be substantially aligned with its respective shunt tube on an adjacent joint before the single connector will function. Unfortunately, this is not always easy to accomplish.

Accordingly, it is desirable that the fluid connections between adjacent shunt tubes can be easily and quickly made or if individually made as in prior alternate-path screens, that these connections be protected from damage during installation and use.

SUMMARY OF THE INVENTION

The present invention provides an alternate-path, well screen which is made-up of joints of screen and which includes a means for fluidly connecting the alternate paths (i.e. shunt tubes) on adjacent joints of screen without requiring axially alignment of the shunts. This is accomplished by positioning a manifold (e.g. sleeve) between the adjacent joints which acts a fluid passage between the lower, open ends of the upper shunts and the upper, open ends of the lower shunts. This allows the joints to be made-up without regard to the axial alignment of the shunts which, in turn, speeds up the assembly and installation of the alternate-path, well screen.

More specifically, the present invention provides an alternate-path, well screen which is comprising of a plurality of screen joints (e.g. 20-foot lengths). Each of the screen joints are of basically the same construction and each is comprised of a permeable section which is adapted to allow the flow of fluid therethrough while blocking the flow of particulates therethrough. Basically, this permeable section is comprised of a base pipe having openings therein, around which a screen material (e.g. wrap wire) is positioned.

At least one alternate flowpath (e.g. shunt tube) having a plurality of openings spaced along its length extends along the length of said point and is open at both ends. A manifold (e.g. a sleeve) extends between the lower end of an upper screen joint and the upper end of a lower screen joint so that it surrounds the lower ends of the shunt tubes on the upper screen joint and the upper ends of the shunt tubes on the lower screen joint to thereby provide a passage for fluid flow between the shunt tubes.

The sleeve preferably has at least one outlet between said upper and lower screen joints so that fluid (e.g. gravel slurry) can flow, into the well annulus adjacent the manifold to insure good gravel distribution over the entire completion interval during a gravel pack operation. Since this outlet may be subject to erosion during the gravel pack operation, an erosion-resistant insert is preferably mounted in the outlet.

A shroud is concentrically positioned over the permeable section of a screen joint and the alternate flowpaths (e.g. shunt tubes) thereon to protect the alternate flowpaths during installation of said well screen. The protective shroud has a plurality of openings in the wall thereof to allow fluid from the openings in the shunt tubes to flow through the shroud and into the well annulus during a gravel sack operation and for fluids to flow into the shroud and through the permeable section during production.

In a further embodiment, the alternate-path, well screen of the present invention includes means for individually connecting the lower ends of the shunt tubes on an upper screen joint to the upper ends of the shunt tubes on said lower screen joint. Each of these fluid connecting means is comprised of individual lengths of tubing having couplings at either end for connecting the length of tubing between its respective shunt tubes. A sleeve is secured between adjacent screen joints around the fluid connecting means to protect same as the well screen is being installed. Further both the lengths of connector tubing and the sleeve preferably have at least one outlet therein so that a portion of the fluid (gravel slurry) flowing through the connecting means can pass into the well annulus and pack the well interval adjacent the sleeve during the gravel pack operation.

BRIEF DESCRIPTION OF THE DRAWINGS

The actual construction, operation, and the apparent advantages of the present invention will be better understood by referring to the drawings, which are not necessarily to scale, in which like numerals identify like parts and in which.

BEST KNOWN MODE FOR CARRYING OUT THE INVENTION

Figure 1:
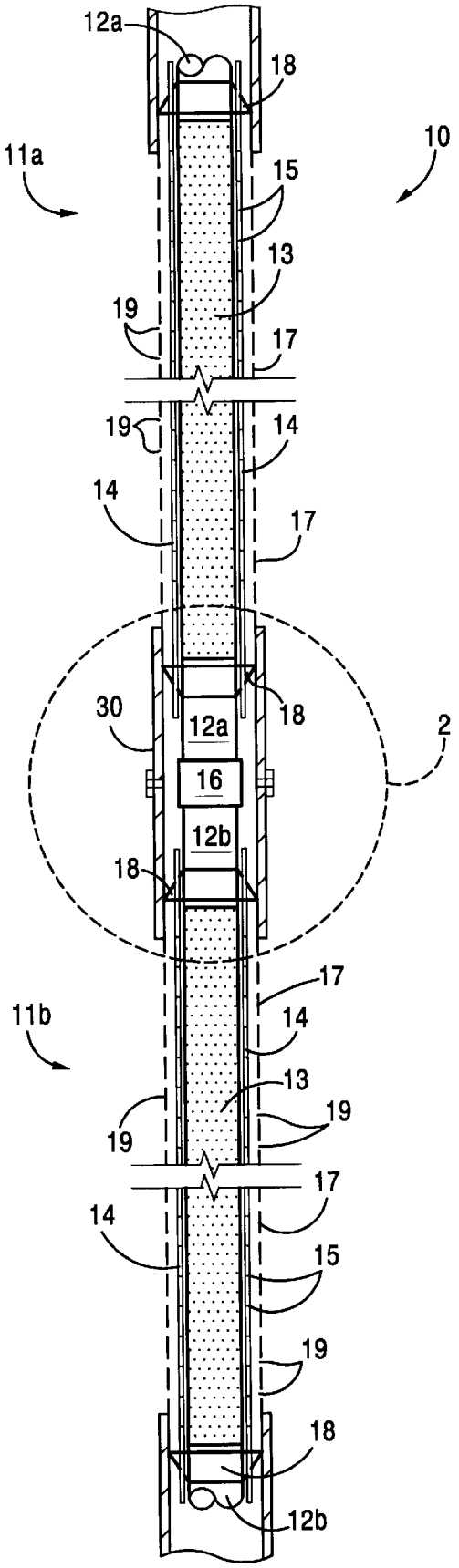
FIG. 1 is broken-away, elevational view, partly in section, of the alternate-path well screen having a manifold, fluid connection between shunt tubes on adjacent joints in accordance with the present invention.

Referring more particularly to the drawings, FIG. 1 illustrates an alternate-path, well screen 10 which is assembled in accordance with the present invention and which is especially useful in the gravel-packing of long intervals of vertical, inclined, and/or horizontal welfares. Well screen 10 is comprised of a plurality of screen "joints" 11 (e.g. 20-foot lengths) which are joined together (e.g. by threaded coupling 16) before or as the well screen is run into a wellbore. Only two joints, i.e. "upper" screen joint 11*a* and "lower" screen joint 11*b*, have been shown. It should be understood that "upper" and "lower", as used herein, are meant to be relative terms and would apply to equivalent positions when screen 10 is used in an inclined and/or horizontal wellbore.

Figure 2:
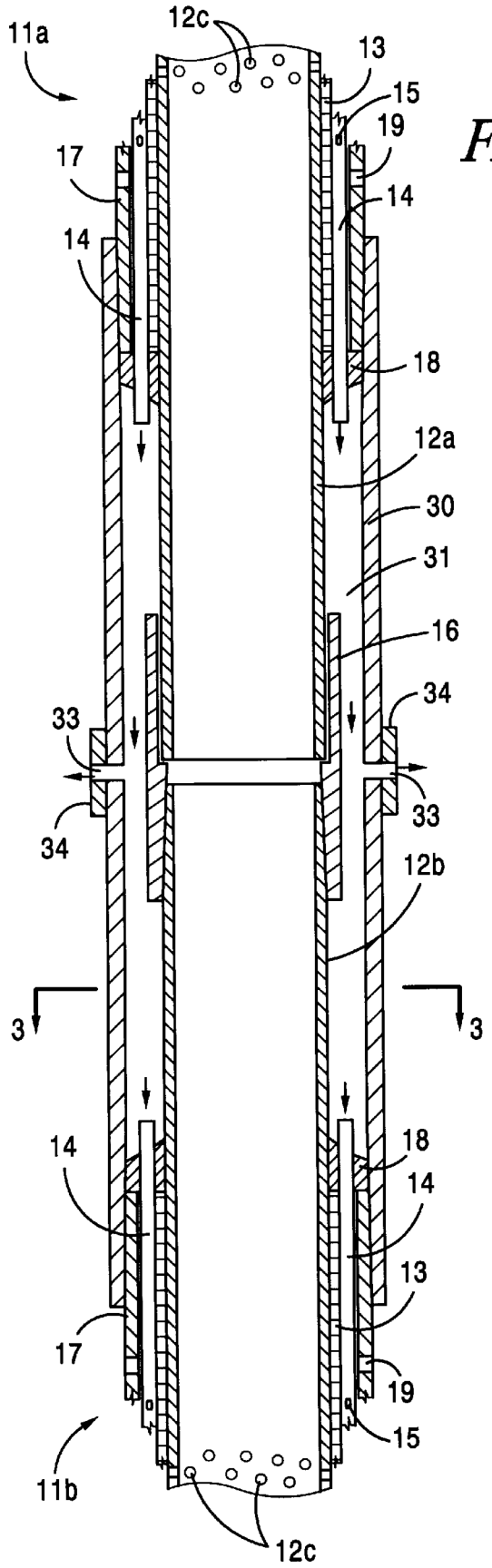
FIG. 2 is an enlarged, cross-sectional view of the fluid connection between adjacent joints of well screen of FIG. 1 taken within circular line 2—2 in FIG. 1.

Each joint has basically the same construction and is illustrated as being comprised of a permeable section which, in turn, is comprised of perforated or slotted base pipe 12*a*, 12*b* respectively, having a plurality of openings 12*c* therethrough (see FIG. 2). A "screen" material (e.g. a continuous coiled length of wrap wire 13) is positioned on base pipe 12. As will be understood in the art, each coil of wrap wire is slightly spaced from the adjacent coils to form fluid passages (not shown) between the coils of wire 13. This technique is commonly used in manufacturing well known, commerically-available well screens, e.g. SUPERWELD SCREENS by US Filter/Johnson Screens, Minneapolis, Minn.

While a particular type of known well screens is used in describing the present invention, it should he understood that the generic term "screen" as used herein is intended to include and cover all types of similar structures which are commonly used in gravel pack well completions which permit flow of fluids through the "screen" while blocking the flow of particulates (e.g. other commercially-available screens, slotted or perforated liners or pipes; sintered-metal screens; sintered-sized, mesh screens; screened pipes; pre-packed screens and/or liners; or combinations thereof) and may even include "blanks" in some applications.

Figure 3:
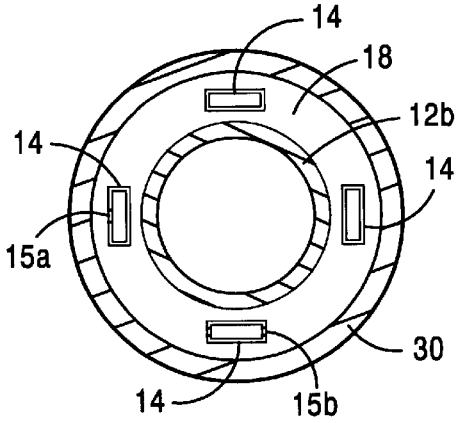
FIG. 3 is a cross-sectional view taken alone, line 3—3 in FIG. 2.

Alternate flowpaths are positioned about the external surface of screen joint 11 end as shown in FIGS. 1–3, are comprised of at least one (four shown) perforated conduits or shunt tubes which extend longitudinally alone the external surface of wire wrap 13. Each shunt tube 14 has a plurality of openings 15 spaced along its length and is open at both ends thereof. Both ends of a respective shunt tube 14 pass through an opening in respective rings 18 which aid in positioning and securing the shunt tubes on screen joint 11.

The openings 15 in tubes 14 can he in the front of tubes 14 (15*a* in FIG. 3) or preferably will open through the sides thereof (15*b* in FIG. 3). Also, due to possible erosion of these openings during gravel-pack operations, erosion-resistant inserts (tungsten carbide, not shown) can be provided in each of the openings 15; see co-pending and commonly-assigned, U.S. patent application Ser. No. 08/825,987, filed Apr. 4, 1997, and which is incorporated herein by reference. (Mobil Docket No. 7924, mailed 3 Apr., 1997, "Erosion Resistant Inserts for Fluid Outlets in a Well Tool and Method for Installing Same").

To protect shunt tubes 14 from damage during installation of screen 10, a protective shroud 17 is concentrically-positioned about screen joint 11. Shroud 17 is comprised of a cylinder made of a strong, durable material, e.g. steel, which is secured at its upper and lower ends to respective rings 18 or the like, which, in turn, are secured to base pipe 12 by welding or the like. The shroud 17 has a plurality of openings 19 (only some of which are numbered in the figures) through the wall thereof to provide an exit for fluid (e.g. gravel slurry) to pass out of the shroud as it flows out the openings 15 in shunt tubes 14 and an entrance for fluids into the shroud and through the permeable section of the screen during production.

By positioning the rigid shroud over the shunt tubes 14, the tubes are protected from any accidential blots or the like during the assembly and installation of the screen which might otherwise severely damage or destroy the shunt tubes for their intended purpose. The construction of screen joint 11 up to this point is basically the same as disclosed and claimed in commonly-assigned and co-pending U.S. patent application Ser. No. 08/719,923, filed Sep. 25, 1996 and which is incorporated herein by reference.

In alternate-path, well screens which are made-up of several screen joints, the shunt tubes 14 on the respective joints have to be fluidly connected to each other as the joints are connected together. This is necessary so that each of the shunt tubes will provide a continuous flowpath for the gravel slurry along the entire length of screen 10 during gravel sack operations.

Figure 4:
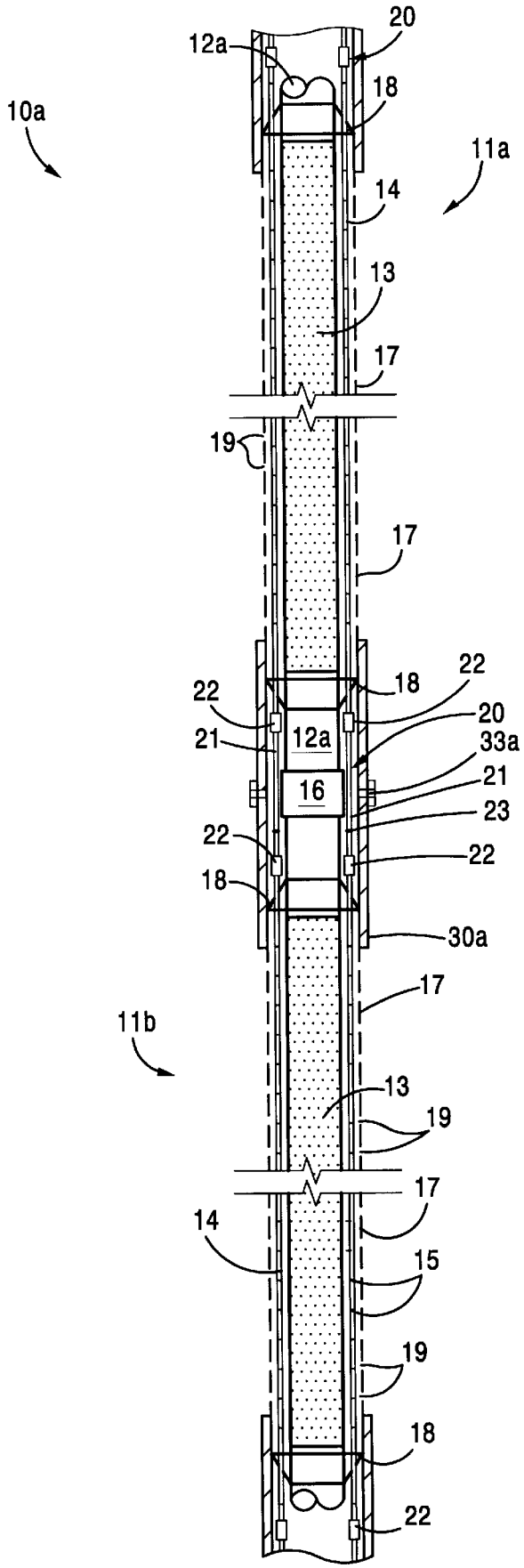
FIG. 4 is a broken-away, elevational view, partly in section, of another embodiment of an alternate-path well screen having protected, fluid connections between shunt tubes on adjacent joints in accordance with the present invention.

In most prior art alternate-path, well screens of this type, the respective base pipes are first threaded together and then the end of each shunt tube on a joint is individually connected to the end of a respective shunt tube on an adjacent joint by an individual connector. A typical connector 20 (FIG. 4) is comprised of relatively short length of tubing 21 (e.g. may be the same tubing as used for shunt tubes 14) which has means (e.g. couplings 22 at each end) for connecting the tubing to the shunt tubes. Typically, one or both of the couplings 22 are slidable on tubing 21 so that the connector can be assembled onto aligned shunt tubes 14 after the joints 11*a*, 11*b* have been connected together. For a more complete discussion on such prior art connectors, see U.S. Pat. No. 5,390,966, issued Feb. 21, 1995 and which is incorporated herein by reference.

When using connectors 20, as described above, the respective shunt tubes on the adjacent joints must be substantially in axially alignment before a connection can be made. This is sometime difficult to achieve and can require additional time to properly align the respective shunt tubes as the base pipes are threaded together. Due to the large number of connections which have to be made in a typical well screen 10, this can substantially increase the run-in time, hence the costs, for well screen 10.

In accordance with one aspect of the present invention, the shunt tubes on adjacent screen joints 11 are fluidly connected without requiring the respective shunt tubes to be in any particular axially alignment. As best seen in FIG. 2, the lower ends of the shunts tubes which extend below ring 18 on the lower end of joint 11*a* are not physically connected to the upper ends of the shunt tubes which extend above ring 18 on the upper end of joint 11*a* but, instead all are open to flow. A manifold (e.g. sleeve 30) is concentrically positioned about the connected base pipes 12*a*, 12*b* and extends between the lower end of upper screen joint 11*a* and the upper end of lower screen joint 11*b*.

Sleeve 30 forms an annulus 31 between itself and the connected base pipes which, in turn, provides a passageway for fluid flow between the lower ends of the upper shunt tubes 14 and the upper ends of the lower shunt tubes. Sleeve 30 may be affixed between the joints in a variety of ways. For example, the upper end of sleeve 30 can be threaded, welded or otherwise secured to the lower end of joint 11*a* so that the lower end of the sleeve will be threaded onto the upper end of joint 11*b* as the base pipes are threaded together.

Further, the upper end of sleeve 30 can be secured to joint 11*a* so that the lower end of sleeve 30 merely slides over the upper end of joint 11*b* as the joints are being assembled. A set screw (not shown), welding, or the like can then be used to secure the lower end of the sleeve to joint 11*b*. Still further, sleeve 30 can be slidably mounted on joint 11*a* and then slid into position after the base pipes are connected and then held in position on joints 11*a* and 11*b* by set screws, welding, etc. . . .

Still another technique which can be used to assemble sleeve 30 between the joints involves making the sleeve in two or more parts (split sleeve) and then assemble the parts around the connected base pipes, securing the parts together with any appropriate means (e.g. screws, welding, bands, etc.). Of course, sealing means (e.g. O-rings or the like, not shown) can be provided at the appropriate places between sleeve 30 and joints 11*a*, 11*b* to prevent any excessive leakage at the manifolding of the joints together. However it should be noted that some leakage is okay since the ultimate purpose of alternate-path screen 10 is to provide a substantially, uniform gravel pack along the entire length of screen 10.

Accordingly, where sleeve 30 is of a substantial length, e.g. 10 feet or such, it is preferably to provide at least one outlet 33 along its length to allow some of the slurry flowing through annulus 31 to deliberately exit into the wellbore to insure that the well annulus adjacent sleeve 30 will be gravel sacked alone with the rest of the completion interval. In other words, outlet 33 acts in the same manner as does the openings 15 in shunt tubes 14. Again, since outlet 33 may have a tendency to erode during the gravel pack operation, it is preferred to provide an erosion-resistant insert 34 (e.g. tungsten carbide) within outlet 33.

By using sleeve 30 to form a fluid manifold between adjacent shunt tubes, it can be seen that the shunt tubes do not have to be in any alignment with respect to each other when the base pipes are threaded together. This allows the screen joints to be made up quickly which, in turn, can amount to a substantial savings in time and labor hence, a substantial savings in costs in using an alternate-path screen.

In another aspect of the present invention (FIG. 4), alternate-path screen 10*a* is made-us using prior art connectors 20 to individually fluidly connect respective shunt tubes 14 together. Sleeve 30*a* is positioned concentrically around the connectors and extends between screen joints 11*a*, 11*b* and is secured thereto in the same manner as discussed above. Sleeve 30*a* effectively forms an extension of shroud 20 and provides protection for connections 20 during installation and operation. Again, if the length of the connection between joints is substantial, e.g. about 10 feet or more, it is preferred that at least one opening 23 be provided in each length of connector tubing 21 and at least one outlet 33*a* be provided in sleeve 30*a* so that gravel slurry flowing through shunt tubes 14 can enter the well annulus adjacent the connection during the gravel rack operation.

What is claimed is:

1. An alternate-path well screen comprising:

at least one upper and one lower screen joints, each of said joints having basically the same construction and each comprising:

a permeable section adapted to allow the flow of fluid therethrough while blocking the flow of particulates therethrough;

a plurality of alternate flowpaths extending along the length of said joint, each of said flowpaths comprising a shunt tube having a plurality of openings along its length, said shunt tube being open at both of its upper and lower ends;

means for connecting the lower end of said upper screen joint to the upper end of said lower screen joint; and a manifold extending between said lower end of said upper screen joint and the upper end of said lower screen joint and surrounding said lower end of each of said shunt tubes on said upper screen joint and the upper ends of said shunt tubes on said lower screen joint to thereby provide a passage for fluid flow between said shunt tubes wherein said manifold comprises:

a sleeve which is connected at one end to the lower end of said upper screen joint and at its other end to the upper end of said lower screen joint wherein flow from all of said shunts tubes on said upper screen joint flows into said sleeve and then from said sleeve into said shunt tubes on said lower screen joint.

2. The alternate-path well screen of claim 1 wherein said sleeve has at least one outlet between said upper and lower screen joints.

3. The alternate-path, well screen of claim 2 including:

an erosion-resistant insert mounted in said at least one outlet in said sleeve.

4. The alternate-path, well screen of claim 1 wherein each of said screen joints include:

a shroud surrounding said permeable section and covering said at least one alternate flowpath to protect said at least one alternate flowpath during installation of said well screen, said shroud having a plurality of openings in the wall thereof.

5. An alternate-path well screen of claim 1 wherein said permeable section comprises:

a base pipe having a plurality of openings therein; and screen material positioned around said base pipe.

6. An alternate-path well screen comprising:

at least one upper and one lower screen joint, each of said joints having basically the same construction and each comprising:

a permeable section adapted to allow the flow of fluid therethrough while blocking the flow of particulates therethrough;

at least one alternate flowpath extending along the length of said joint, said flowpath comprising a shunt tube having a plurality of openings along its length, said shunt tube being open at both its upper and lower ends; and a shroud surrounding said permeable section and covering said at least one alternate flowpath to protect said at least one alternate flowpath during installation of said well screen, said shroud having a plurality of openings in the wall thereof;

means for connecting the lower end of said upper screen joint to the upper end of said lower screen joint;

means for connecting said at least one shunt tube on said upper screen joint to said at least one shunt tube on said lower screen joint to thereby provide a fluid passage between said shunt tubes; said connecting means comprising:

a length of tubing having a first end and a second end; and means for connecting said first end of said length of tubing to said lower end of said at least one shunt tube on said upper screen joint and for connecting said second end of said length of tubing to said upper end of said at least one shunt tube on said lower screen joint to thereby provide a fluid passage between said shunt tubes; and means for protecting said means for connecting said shunt tubes, said protection means comprising a sleeve connected between said lower end of said upper screen joint and the upper end of said lower screen joint and surrounding said length of tubing.

7. An alternate-path well screen of claim 6 wherein said length of tubing has at least one opening therein and wherein said sleeve has at least one outlet therein positioned between said upper and lower screen joints.

* * * * *